US008403701B2

(12) United States Patent
Han et al.

(10) Patent No.: US 8,403,701 B2
(45) Date of Patent: Mar. 26, 2013

(54) ELECTRICAL CONNECTOR HAVING IMPROVED GROUNDING MEMBERS

(75) Inventors: Hao Han, Kunshan (CN); Zhi-Jian Liu, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/290,339

(22) Filed: Nov. 7, 2011

(65) Prior Publication Data

US 2012/0115364 A1 May 10, 2012

(30) Foreign Application Priority Data

Nov. 5, 2010 (CN) ..... 2010 2 0593463

(51) Int. Cl.
*H01R 13/648* (2006.01)

(52) U.S. Cl. ..... 439/541.5; 439/607.26

(58) Field of Classification Search ..... 439/541.5, 439/607.26, 92, 95, 108, 676
See application file for complete search history.

(56) References Cited

U.S. PATENT DOCUMENTS

| | | | | |
|---|---|---|---|---|
| 7,033,210 | B1 | 4/2006 | Laurer et al. | |
| 7,674,136 | B2 | 3/2010 | Steinke et al. | |
| 7,736,176 | B2 * | 6/2010 | Zhang et al. | 439/541.5 |
| 2005/0106939 | A1 * | 5/2005 | Zhang et al. | 439/607 |
| 2005/0255746 | A1 * | 11/2005 | Hyland | 439/541.5 |

FOREIGN PATENT DOCUMENTS

| | | |
|---|---|---|
| TW | 452261 | 8/2001 |

* cited by examiner

*Primary Examiner* — Gary F. Paumen
(74) *Attorney, Agent, or Firm* — Ming Chieh Chang; Wei Te Chung

(57) ABSTRACT

An electrical connector (100) includes an insulative housing (3), a contact module (4) assembled to the insulative housing and a shielding shell (5) attached to an outer side of the insulative housing. The contact module includes a terminal group and a pair of paddle boards (42) disposed at opposite sides of the terminal group and electrically connected with the terminal group. Each paddle board has a grounding pad (4211). The shell includes a wall (510) parallel with a front face. The wall has a pair of forwardly extending grounding beams (52) respectively contacting the pair of grounding pads of the pair of paddle boards for grounding.

20 Claims, 6 Drawing Sheets

ELECTRICAL CONNECTOR HAVING IMPROVED GROUNDING MEMBERS

BACKGROUND OF THE INVENTION

1. Field of the Invention

The present invention relates to an electrical connector, and more particularly to a modular jack connector having improved grounding members for application in high speed signal transmission systems.

2. Description of Related Art

U.S. Pat. No. 7,674,136 issued to Steinke et al. on Mar. 9, 2010 discloses a modular jack connector including an insulative housing, a contact module assembled to the insulative housing, a grounding plate and a shielding shell attached to the insulative housing. The contact module comprises a pair of stacked terminal group halves and a pair of paddle boards. The grounding plate is mounted between the pair of terminal group halves and has a grounding portion contacting the shielding shell and a pair of grounding beams respectively contacting the pair of paddle boards.

TW Patent No. 452261 issued to Speed Tech on Aug. 1, 2001 discloses a modular jack connector including an insulative housing, a contact module assembled to the insulative housing having a front face, and a shielding shell attached to the insulative housing. The contact module comprises a vertical paddle board parallel with the front face. The shielding shell includes a front shell and a rear shell having a grounding beam extending downwardly for contacting the paddle board.

Hence, an electrical connector having differently configured grounding members is desired.

SUMMARY OF THE INVENTION

Accordingly, an object of the present invention is to provide an electrical connector having grounding members performing grounding purpose easily.

In order to achieve the object set forth, an electrical connector includes an insulative housing, a contact module assembled to the insulative housing and a shielding shell attached to an outer side of the insulative housing. The contact module includes a terminal group and a pair of paddle boards disposed at opposite sides of the terminal group and electrically connected with the terminal group. Each paddle board has a grounding pad. The shell includes a wall parallel with a front face. The wall has a pair of forwardly extending grounding beams respectively contacting the pair of grounding pads of the pair of paddle boards for grounding.

It is an easy manufacturing process to form the grounding beams on the shell, devoid of manufacturing an extra grounding plate. It is an easy operation to contact the grounding beams with the grounding pads of the paddle boards, for grounding.

Other objects, advantages and novel features of the invention will become more apparent from the following detailed description when taken in conjunction with the accompanying drawings.

DETAILED DESCRIPTION OF THE PREFERRED EMBODIMENT

Figure 1:
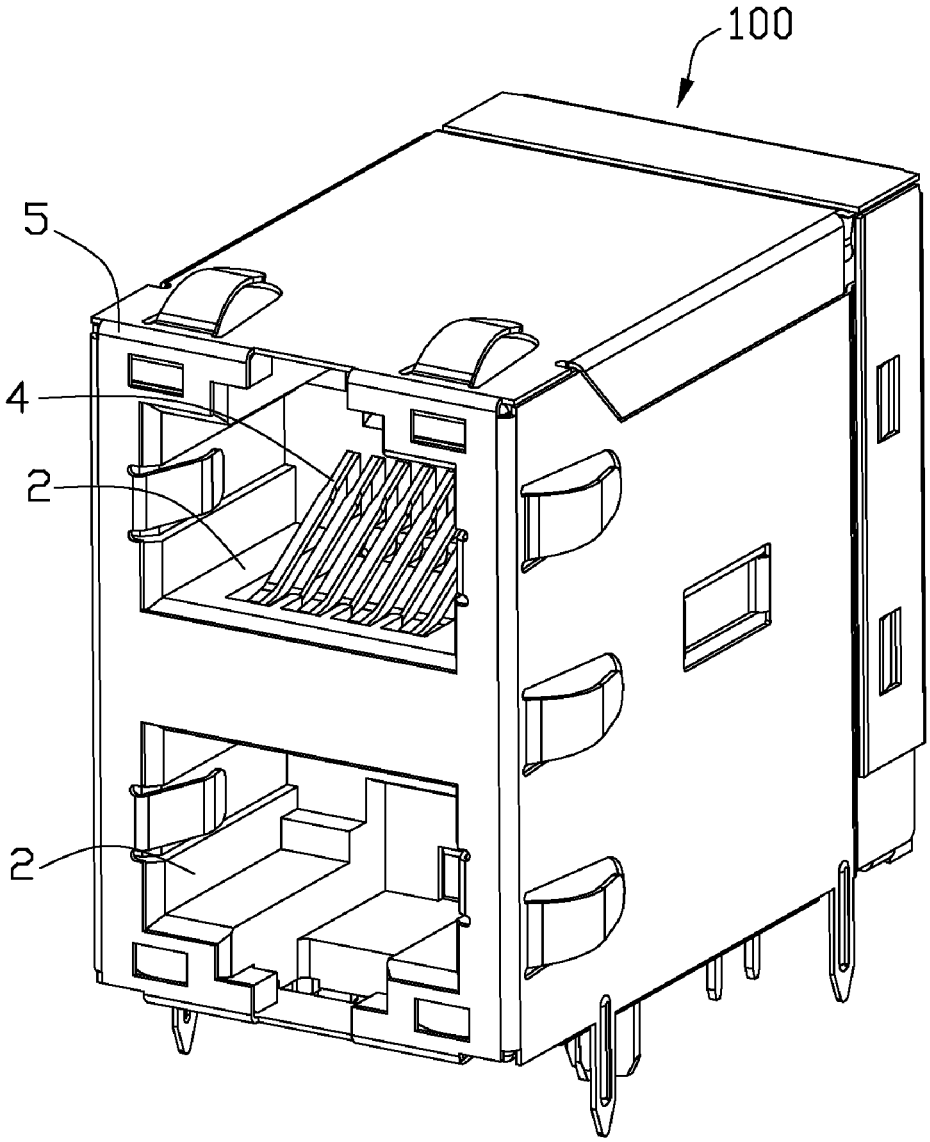
FIG. 1 is an assembled perspective view showing an electrical connector in accordance with the present invention.
Figure 2:
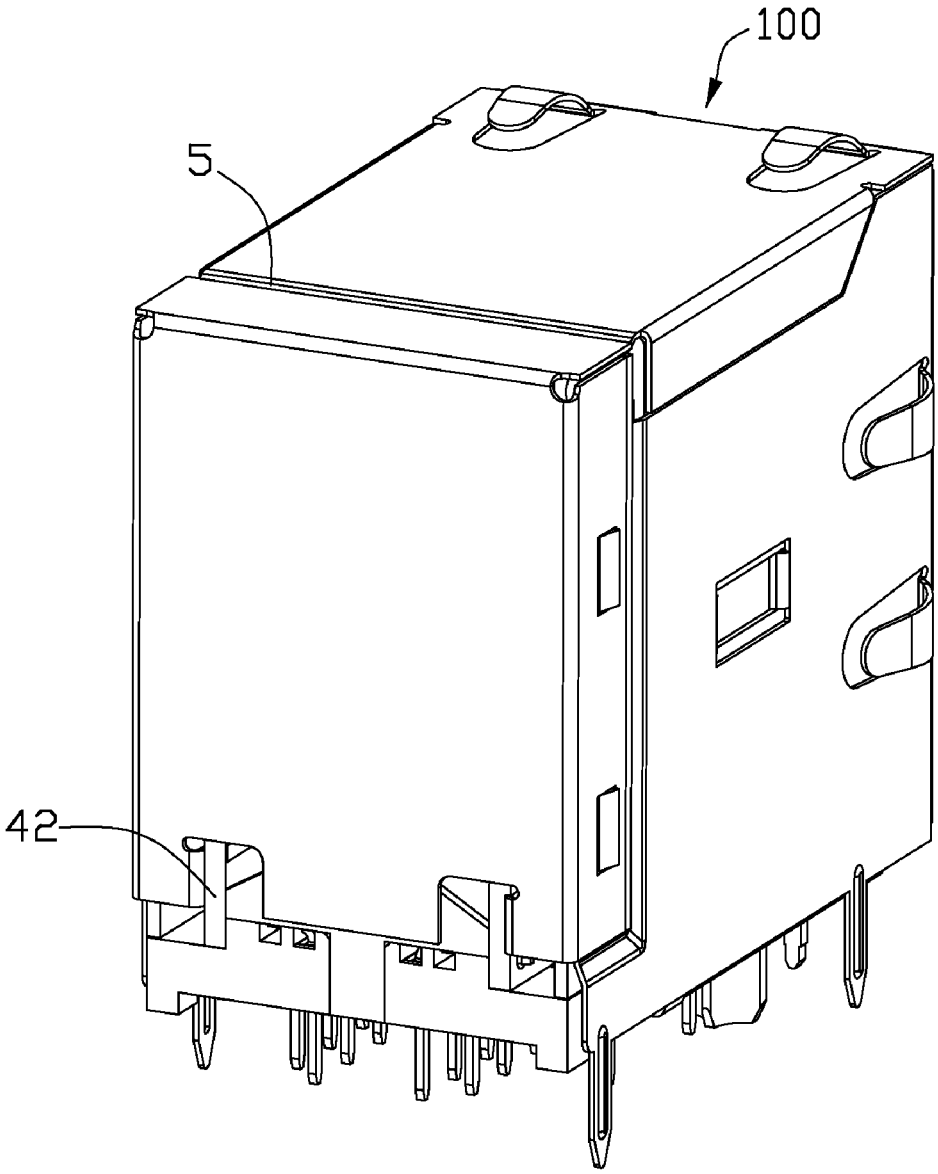
FIG. 2 is another assembled perspective view similar to FIG. 1, taken from another aspect.
Figure 3:
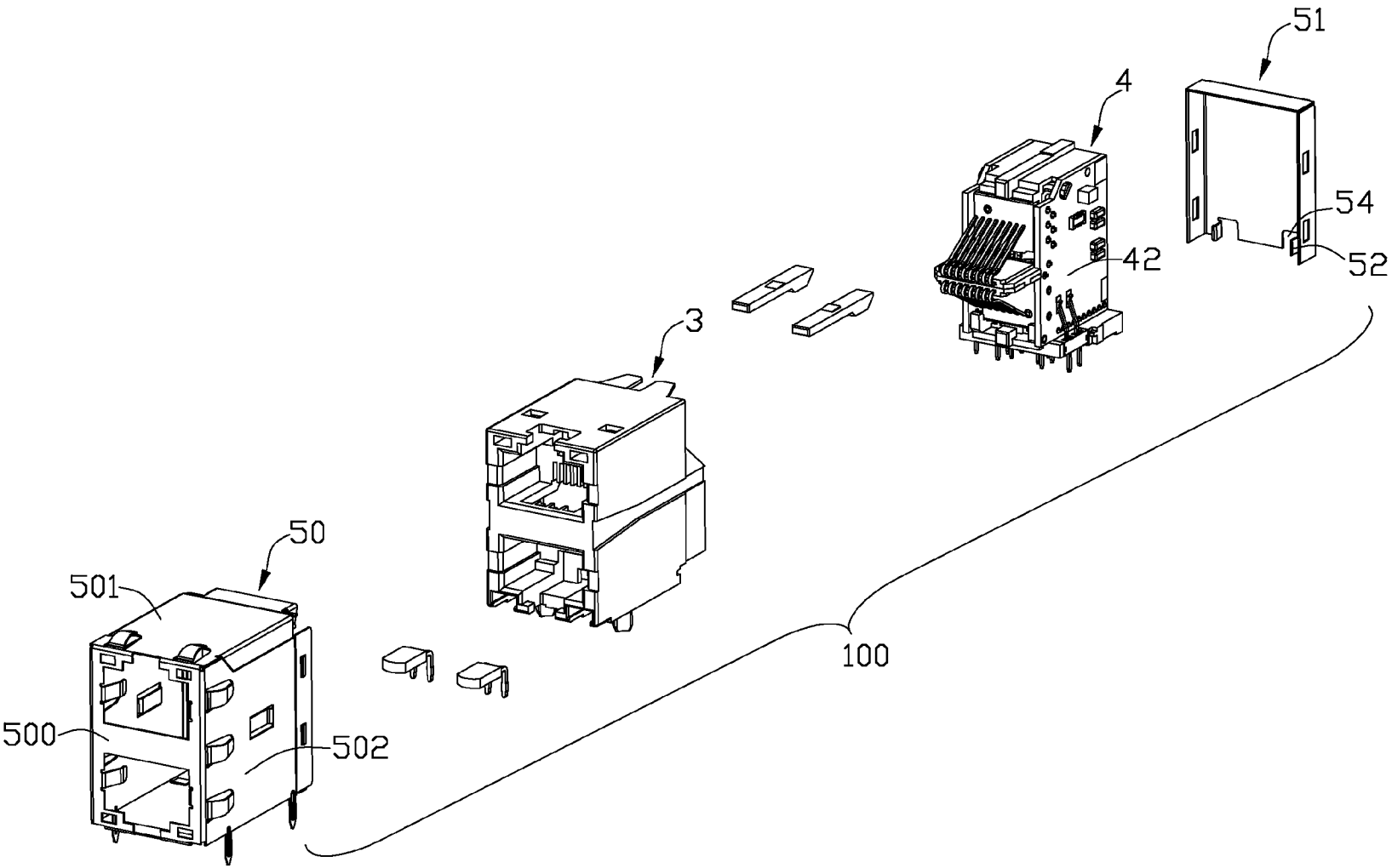
FIG. 3 is a partially exploded view showing the electrical connector.
Figure 4:
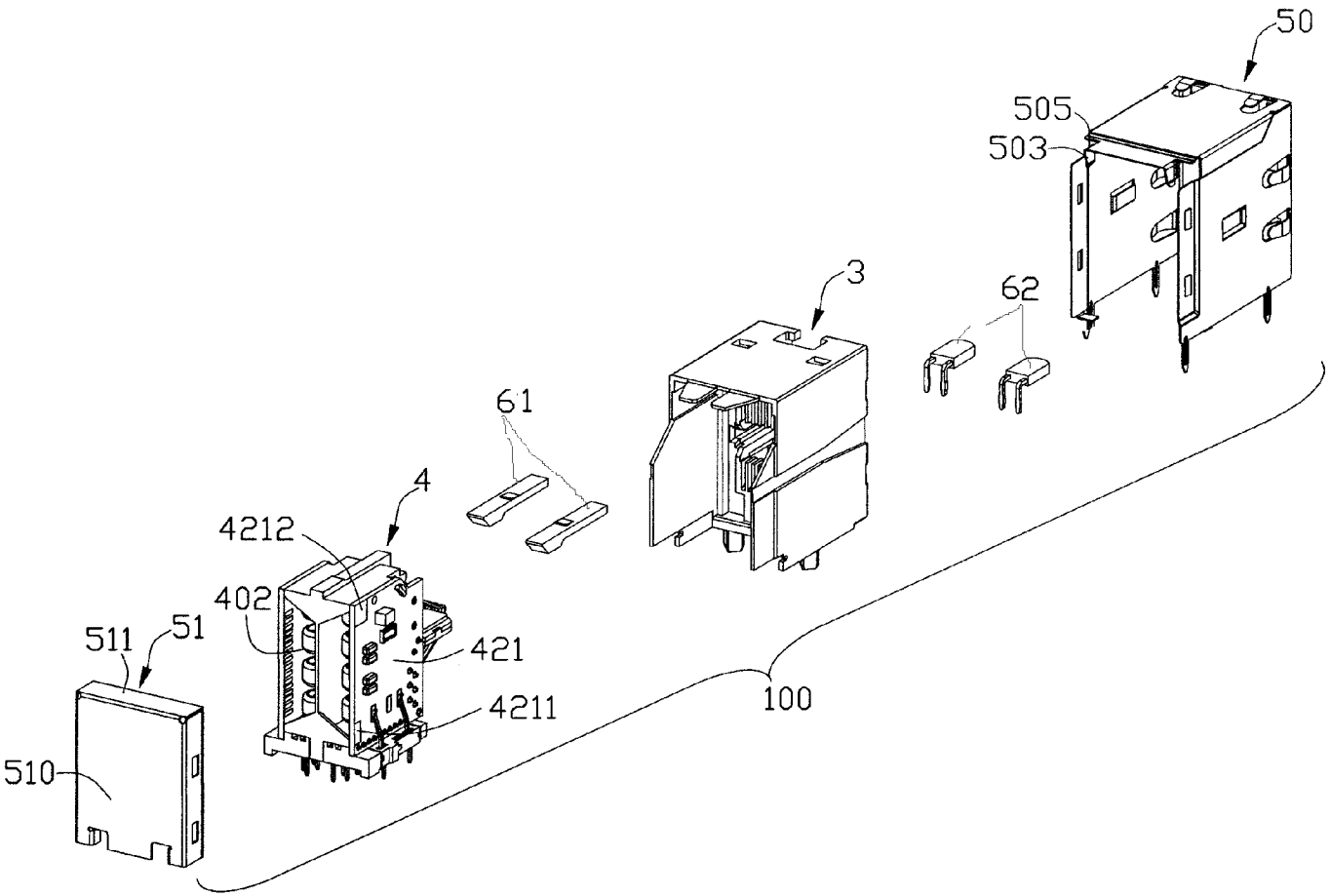
FIG. 4 is another partially exploded view similar to FIG. 3, taken from another aspect.
Figure 5:
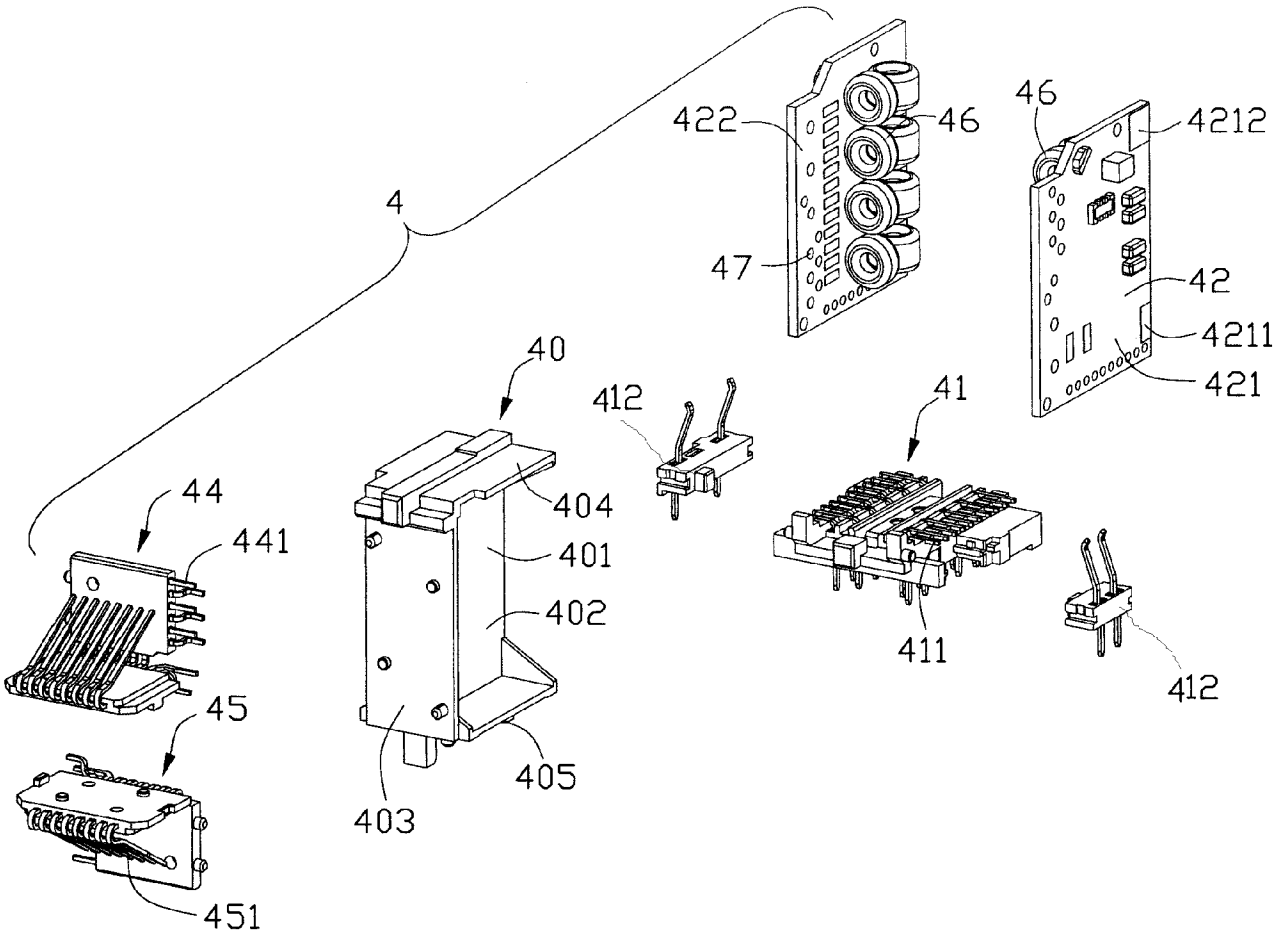
FIG. 5 is an exploded view showing a contact module.

Reference will now be made in detail to the preferred embodiment of the present invention. Referring to FIGS. 1-4, an electrical connector 100 comprises an insulative housing 3 defining a pair of stacked ports 2, a contact module 4 assembled to the insulative housing 3, and a shielding shell 5 attached to an outer side of the insulative housing 3.

Referring to FIGS. 3-6, a contact module 4 comprises a bracket 40, a pair of paddle boards 42, a terminal group, and a converting module 41 having a plurality of converting terminals 411. The terminal group includes an upper terminal group half 44 having a plurality of upper terminals 441, and a lower terminal group half 45 having a plurality of lower terminals 451.

The bracket 40 has a front wall 403, an inner wall 401 perpendicular to the front wall 403, a pair of cavities 402 defined at opposite sides of the inner wall 401, a pair of upper flanges 404 and a pair of lower flanges 405 disposed at upper and lower sides of the cavities 402.

Each paddle board 42 comprises an inner face 422, an outer face 421 opposite to the inner face 422, and a plurality of conductive holes 47 extending through the inner and outer faces 422, 421. The inner face 422 of the paddle board 42 has a plurality of magnetic components 46 soldered thereon. The outer face 421 of the paddle board 42 has a first grounding pad 4211 formed at a lower portion thereof and a second grounding pad 4212 formed at an upper portion thereof.

In assembling of the contact module 4, the pair of paddle boards 42 are disposed at opposite sides of the bracket 40, and abut against the pair of upper and lower flanges 404, 405, with the inner faces 422 facing the cavities 402 and the magnetic components 46 received in the cavities 402. The terminal group is mounted on the front wall 403 of the bracket 40 partially between the pair of paddle boards 42, with the upper terminals 441 of the upper terminal group half 44 inserted into the conductive holes 47 of one paddle board 42, and with the lower terminals 451 of the lower terminal group half 45 inserted into the conductive holes 47 of the other paddle board 42. The converting module 41 is attached to a rear side of the bracket 40, with the converting terminals 411 electrically connected with the paddle boards 42. The converting module 41 is equipped with a pair of contact blocks 412 assembled to two lateral sides of the bracket 40 with corresponding contacts contacting the corresponding outward surface of the corresponding paddle boards 42.

Figure 6:
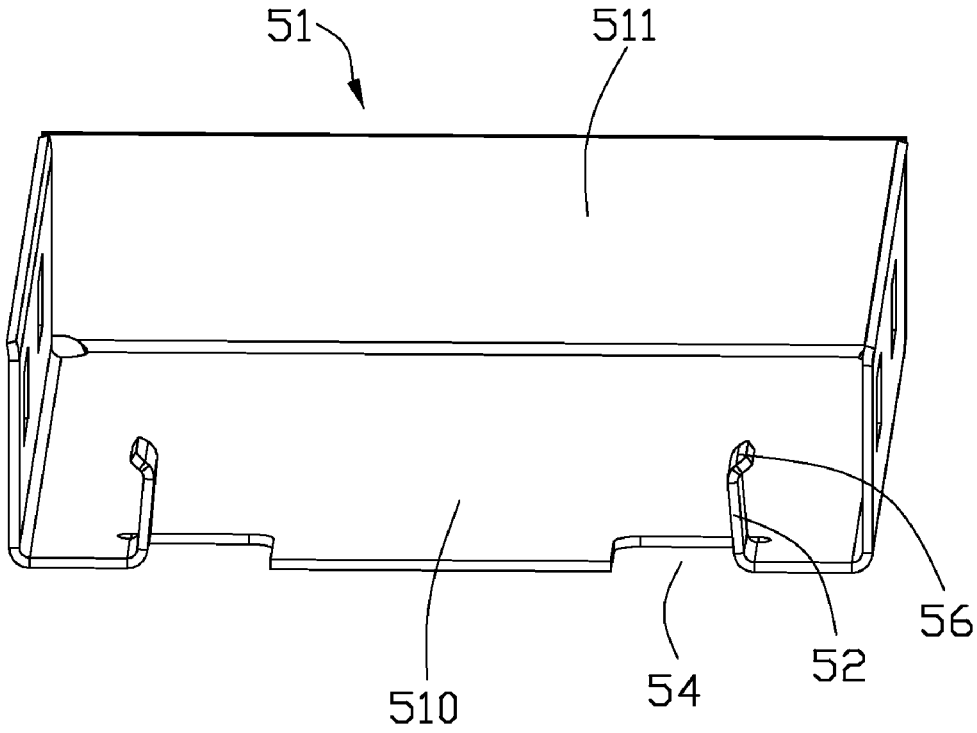
FIG. 6 is a perspective view showing a rear shell.

In conjunction with FIG. 6, the shielding shell 5 includes a front shell 50 and a rear shell 51 cooperated with the front shell 50. The rear shell 51 includes a rear wall 510 and three protruding walls 511 projecting forwardly from a front edge and a pair of side edges of the rear wall 510. The rear wall 510 of the rear shell 51 has a pair of grounding beams 52 each punched from a lower portion of the rear wall 510 to have a forwardly extending configuration and a cutout 54 beside the grounding beam 52. Each grounding beam 52 has a free end bent outwardly to form a guiding portion 56.

The front shell 50 has a top wall 501, a front wall 500, a pair of side walls 502. The top wall 501 has a pair of grounding portions 503 punched from opposite sides of the top wall 501 to have downwardly extending configurations and an indentation 505 beside each grounding portion 503.

Referring to FIGS. 1-6, in assembling of the electrical connector 100 which is seated upon a printed circuit board (not shown), the contact module 4 is assembled to the insulative housing 3, with the upper and lower terminal group halves 44, 45 received in the pair of ports 2. An upper pair of LEDs (Laser Emit Diode) 61 is electrically connected to the printed circuit board, via the corresponding pair of paddle boards while a lower pair of LEDs 62 is directly connected to the printed circuit board. The front shell 50 is attached to the insulative housing 3 and shields most of the contact module 4. The pair of grounding portions 503 respectively abut against and contact with the second grounding pads 4212 of the pair of paddle boards 42. The rear shell 51 is attached to a rear side of the contact module 4. The pair of grounding beams 52 respectively abut against and contact with the first grounding pads 4211 of the pair of paddle boards 42, via a guide of the guiding portions 56. The rear shell 51 is latched with the front shell 50 via an engagement between a locking hole (not labeled) formed on one of the shells 50, 51 and a locking protrusion (not labeled) formed on the other one of the shells 50, 51.

It is an easy manufacturing process to form the grounding beams 52 and the grounding portions 503 on the shielding shell 5 by punching. It is an easy operation to contact the grounding beams 52 with the first grounding pads 4211 of the paddle boards 42 and contact the grounding portions 503 with the second grounding pads 4212 of the paddle boards 42, for grounding. Additionally, the paddle board 42 could be designed into a smaller dimension to locate the magnetic components 46 and the first and second grounding pads 4211, 4212, since the magnetic components 46 are soldered on the inner face 422 and the first and second grounding pads 4211, 4212 are formed at the outer face 421 of the paddle board 42.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a front face;

a contact module assembled to the insulative housing and comprising a terminal group and a pair of paddle boards disposed at opposite sides of the terminal group and electrically connected with the terminal group, each paddle board having a grounding pad; and a first shell attached to an outer side of the insulative housing and including a first wall parallel with the front face and having a pair of forwardly extending grounding beams respectively contacting the pair of grounding pads of the pair of paddle boards for grounding.

2. The electrical connector as claimed in claim 1, wherein each grounding beam is punched from a lower edge of the first wall of the first shell to have a cutout beside the grounding beam.

3. The electrical connector as claimed in claim 2, wherein each paddle board comprises an inner face and an outer face, said grounding pad being formed on the outer face of the paddle board, said pair of grounding beams respectively abutting against and contacting the grounding pads of the pair of paddle boards.

4. The electrical connector as claimed in claim 3, wherein each grounding beam has a free end bent outwardly to form a guiding portion.

5. The electrical connector as claimed in claim 3, further comprising a second shell attached to the outer side of the insulative housing and cooperated with the first shell, said second shell having a top wall and a pair of grounding portions each punched from opposite sides of the top wall to have a downwardly extending configuration and an indentation beside the grounding portion.

6. The electrical connector as claimed in claim 5, wherein each paddle board has another grounding pad at the outer face, said pair of grounding portions respectively abutting against and contacting the another grounding pads of the pair of paddle boards.

7. The electrical connector as claimed in claim 5, wherein said first shell is attached to a rear side of the contact module and said second shell shields most of the contact module.

8. The electrical connector as claimed in claim 3, wherein said contact module comprises a bracket defining a pair of cavities, said inner face of each paddle board facing the cavity, said paddle board having a plurality of magnetic components soldered on the inner face and received in the cavity.

9. The electrical connector as claimed in claim 7, wherein said terminal group comprises an upper terminal group half and a lower terminal group half mounted on the bracket and respectively electrically connected with the paddle boards.

10. The electrical connector as claimed in claim 3, wherein said contact module comprises a converting module supporting the paddle boards having a plurality of converting terminals electrically connecting with the paddle boards.

11. An electrical connector assembly comprising:

an insulative housing defining upper and lower ports in a vertical direction;

a contact module assembled to the housing and including a bracket with an upper group terminal half and a lower group terminal half around a front portion of the bracket, in a front-to-back direction perpendicular to said vertical direction, to having corresponding upper and lower terminals positioned in the corresponding upper and lower ports, respectively, a converting module located around a lower portion of the bracket with corresponding contacts associated therewith, and a pair of paddle boards located on two lateral sides in a transverse direction perpendicular to both said vertical direction and said front-to-back direction, each of the paddle boards extending in a vertical plane defined by said vertical direction and said front-to-back direction and defining opposite outward and inward surfaces thereon under condition that the bracket and the converting module are configured to allow the corresponding paddle board to be assembled thereto in only the transverse direction; and a metallic shell enclosing the housing and the contact module with at least one grounding beam mechanically and electrically contacting the corresponding paddle board for grounding.

12. The electrical connector assembly as claimed in claim 11, wherein the grounding beam contacts the outward surface of the corresponding paddle board.

13. The electrical connector assembly as claimed in claim 12, wherein the grounding beam essentially extends in a front-to-back direction.

14. The electrical connector assembly as claimed in claim 11, wherein said grounding beam is located around a lower portion of the shell.

15. The electrical connector assembly as claimed in claim 11, further including a pair of contact blocks assembled unto the two lateral sides of the bracket, respectively, with corresponding contacts contacting the corresponding outward surfaces of the paddle boards.

16. The electrical connector assembly as claimed in claim 15, wherein the contact block and the bracket are configured to have the contact block assembled to the bracket in only the transverse direction.

17. An electrical connector assembly for mounting to a printed circuit board, comprising:

an insulative housing defining upper and lower ports in a vertical direction;

a contact module assembled to the housing and including a bracket with an upper group terminal half and a lower group terminal half around a front portion of the bracket, in a front-to-back direction perpendicular to said vertical direction, to having corresponding upper and lower terminals positioned in the corresponding upper and lower ports, respectively, a converting module located around a lower portion of the bracket with corresponding contacts associated therewith, and a pair of paddle boards located on two lateral sides in a transverse direction perpendicular to both said vertical direction and said front-to-back direction, each of the paddle boards extending in a vertical plane defined by said vertical direction and said front-to-back direction and defining opposite outward and inward surfaces thereon under condition that the bracket and the converting module are configured to allow the corresponding paddle board to be assembled thereto in only the transverse direction; and a pair of contact blocks assembled unto the two lateral sides of the bracket, respectively, with corresponding contacts contacting the corresponding outward surfaces of the corresponding paddle boards.

18. The electrical connector assembly as claimed in claim 17, wherein the contact block and the bracket are configured to have the contact block assembled to the bracket in only the transverse direction.

19. The electrical connector assembly as claimed in claim 18, wherein said shell transversely shields the pair of contact blocks.

20. The electrical connector assembly as claimed in claim 19, further including upper and lower pairs of LEDs, wherein the upper pair of LEDs is electrically connected to the printed circuit board via the corresponding pair of paddle board while the lower pair of LEDs is directly electricallty connected to the printed circuit board.

* * * * *